US007066019B1

(12) United States Patent
Papanastasiou

(10) Patent No.: US 7,066,019 B1
(45) Date of Patent: Jun. 27, 2006

(54) CAVITY STABILITY PREDICTION METHOD FOR WELLBORES

(75) Inventor: Panos Papanastasiou, Hardwick (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 445 days.

(21) Appl. No.: 10/009,505

(22) PCT Filed: Jun. 22, 2000

(86) PCT No.: PCT/GB00/02471

§ 371 (c)(1),
(2), (4) Date: Nov. 18, 2002

(87) PCT Pub. No.: WO01/00962

PCT Pub. Date: Jan. 4, 2001

(30) Foreign Application Priority Data

Jun. 23, 1999 (GB) ..... 9914505.4

(51) Int. Cl.
*E21B 47/00* (2006.01)

(52) U.S. Cl. ..... 73/152.59; 73/152.51

(58) Field of Classification Search ..... 73/152.59, 73/152.51

See application file for complete search history.

(56) References Cited

U.S. PATENT DOCUMENTS

| | | | | |
|---|---|---|---|---|
| 3,907,034 A | | 9/1975 | Suman, Jr. | 166/250 |
| 4,599,904 A | * | 7/1986 | Fontenot | 73/783 |
| 4,862,991 A | | 9/1989 | Hoyle et al. | 181/106 |
| 4,881,208 A | | 11/1989 | Liu | 367/35 |
| 4,951,267 A | | 8/1990 | Chang et al. | 367/31 |
| 5,353,637 A | * | 10/1994 | Plumb et al. | 73/152.17 |
| 5,497,658 A | | 3/1996 | Fletcher et al. | 73/151 |
| 5,517,854 A | * | 5/1996 | Plumb et al. | 73/152.59 |
| 5,619,475 A | | 4/1997 | Winkler | 367/27 |
| 5,789,669 A | | 8/1998 | Flaum | 73/152.51 |
| 5,838,633 A | | 11/1998 | Sinha | 367/31 |
| 6,098,021 A | * | 8/2000 | Tang et al. | 702/14 |
| 6,386,297 B1 | * | 5/2002 | Cooley et al. | 175/39 |

(Continued)

FOREIGN PATENT DOCUMENTS

GB 2293652 A 8/1995

OTHER PUBLICATIONS

N. Morita. "Field and Laboratory Verifications of Sand Production Prediction Models". Feb. 7-10, 1994. SPE 27341, pp. 19-28.

(Continued)

*Primary Examiner*—Hezron Williams
*Assistant Examiner*—John Fitzgerald
(74) *Attorney, Agent, or Firm*—William L. Wang; William B. Batzer; Dale Gaudier

(57) ABSTRACT

A method of predicting the failure of a rock formation surrounding a subterranean cavity, including a measuring set of parameters relating to pressure conditions and stresses in the rock formation surrounding the cavity; using the set of parameters to determine a rock strength; determining a first characteristic length relating to the size of the cavity; determining a second characteristic length relating to the grain size of the rock formation surrounding the cavity; using the first and second characteristic lengths to determine a correction for the rock strength; correcting said rock strength; and using a failure criterion and the corrected rock strength to predict a condition under which the rock formation is expected to produce debris. The results of the prediction can be used to monitor wellbore stability while drilling or optimize the production parameters for a hydrocarbon reservoir.

9 Claims, 3 Drawing Sheets

U.S. PATENT DOCUMENTS

| | | | | |
|---|---|---|---|---|
| 6,655,220 | B1 * | 12/2003 | Reiffsteck | 73/824 |
| 2002/0147574 | A1 * | 10/2002 | Ong et al. | 703/10 |
| 2004/0122640 | A1 * | 6/2004 | Dusterholt | 703/10 |

OTHER PUBLICATIONS

J. Zhang et al. "Mechanical Strength of Reservoir Materials: Key Information for Sand Prediction". SPE 49134, Sep. 27-30, 1998, pp. 423-430.
H. Asheim. "Determination of Perforation Schemes to Control Production and Injection Profiles Along Horizontal Wells". SPE, Mar. 1997, pp. 13-17.
C. Presles et al. "A Sand Failure Test can Cut Both Completion Costs and the Number of Development Wells". SPE 38186, Mar. 1997, pp. 13-17.
F. Sanfilippo et al. "Sand Production: from Prediction to Management". SPE 38185, (1997), pp. 389-398.
J. Tronvoll et al. "Sand Production: Mechanical Failure or Hydrodynamic Erosion?" Int. J. Rock Mech. & Min. Sci., vol. 34, No. 3/4, Paper No. 291, (1997), pp. 1-11.
A. Skjaerstein et al. "Hydrodynamic Erosion: A Potential Mechanism of Sand Production in Weak Sandstones". Int. J. Rock Mech. & Min. Sci., vol. 34, No. 3-4, Paper No. 292 (1997), pp. 1-20.
T. E. Unander et al. "Flow Geometry Effects on Sand Production from Oil Producing Perforation Cavity". Int. J. Rock Mech. & Min. Sci., vol. 34, No. 3/4, Paper No. 293 (1997), pp. 1-11.
H. Vaziri. "Physical Modeling of Sand Production". Int. J. Rock Mech. & Min. Sci., vol. 34, No. 3/4, Paper No. 323 (1997), pp. 1-19.
R.M. O'Connor et al. "Discrete Element Modeling of Sand Production". Int. J. Rock Mech. Min. Sci., vol. 34, No. 3/4, Paper No. 231 (1997), pp. 1-19.
A. Skjaerstein et al. "Effect of Water Breakthrough on Sand Production: Experimental and Field Evidence". SPE 38806 (1997), pp. 565-575.
J. Bear. "Dynamics of Fluids in Porous Media". Elsevier (1988), pp. 165-167.
E. Fjaer et al. "Petroleum Related Rock Mechanics". Elsevier (1992). pp. 109-134.
R. A. Plumb. "Influence of Composition and Texture on the Failure Properties of Clastic Rocks". Eurock '94, (1994) pp. 13-20.
E. Papamichos et al. "Size Dependency of Castlegate and Berea Sandstone Hollow-Cylinder Strength on the Basis of Bifurcation Theory". Rock Mechanics (1995), pp. 301-306.
J. Tronvoll et al. "Perforation Cavity Stability: Investigation of Failure Mechanisms". Geotech. Eng. of Hard Soils-Soft Rocks (1993), pp. 1687-1693.
J. Weingarten. "Prediction of Sand Production in Gas Wells: Methods and Gulf of Mexico Case Studies". SPE 24797 (1992), pp. 317-324.
P. A. Fletcher. "Optimizing Hydraulic Fracture Length to Prevent Formation Failure in Oil and Gas Reservoirs". Rock Mechanics (1995), pp. 293-298.
R. Risnes et al. "Sand Stresses Around a Wellbore". SPE 9650 (1982), pp. 709-720.
W. F. Chen et al. "Non-linear Analysis in Soil Mechanics: Theory and Implementation", Dev. in Geotech. Eng. 53 (1990), pp. 36-39.

* cited by examiner

CAVITY STABILITY PREDICTION METHOD FOR WELLBORES

This invention relates to a method of estimating or predicting the stability of cavities in a subterranean formation. It further pertains to using such estimates to control and set operation parameters for drilling and producing hydrocarbon wells.

BACKGROUND OF THE INVENTION

For the production of hydrocarbon wellbores are drilled into subterranean formations. Subsurface formations encountered in oil and gas drilling are compacted under in situ stresses due to overburden weight, tectonic effects, confinement and pore pressure. When the wellbore is drilled in a formation, the rock near the wellbore is subjected to increased shear stresses due to a reduction in confinement at the wellbore face after removal of the rock from the hole. Compressive failure of the rock near the wellbore will occur if the rock does not have sufficient strength to support the increased shear stresses imposed upon it.

Formation stability problems are not only encountered during the drilling of the wellbore. For the production of hydrocarbons, the hydrocarbon bearing formation is usually perforated or fractured to enable and stimulate the fluid flow into the wellbore. When producing from unconsolidated or weakly-consolidated reservoirs, the formation tends to produce particulates (e.g. sand) along with the hydrocarbons.

Formation sand is produced when the combined effects of fluid drag and near-wellbore stresses cause disaggregation near the perforation or fracture. Individual grains of sand are detached from the matrix forming the formation. At relatively low flow rates, fluid drag does not affect the stability, but as flow rate increases, drag forces become sufficiently high to remove sand particles from the matrix.

Flowrate from a formation is normally controlled by the perforation drawdown pressure (DP) which is the difference between the pore pressure ($p_w$) in the formation and the bottomhole pressure ($P_0$) and can hence be expressed as $DP=P_0-p_w$.

The critical drawdown pressure (CDP) is the value of DP at which the rock matrix surrounding the perforation begins to de-stabilize. Its value is determined by the maximum calculated rock strength.

To model the maximum rock strength classical elastic and elasto-plastic theories, failure criteria and fracture mechanics have been applied. Models use empirically or semi-empirically derived rock strength values to predict formation behavior by using classical theories and stress, pore pressure and empirically derived strength data from various wells.

There are several methods for predicting when for example sand production will occur in a particular well. Such methods are disclosed and discussed in the U.S. Pat. No. 5,497,658 and references contained therein. Known rock failure criteria as discussed in this and other published document are referred to as Mohr-Coulomb, critical state, Drucker-Pager model or as extended Von Mises criterion To apply the failure criteria it is necessary to measure rock properties and the formation fluid properties from core samples, wellbore logs, and the like.

It is therefore an object of the present invention to provide a novel method of estimating the strength of cavities in the subterranean formation, particulary the initiation of sand production in subterranean (sandstone) formations.

SUMMARY OF THE INVENTION

According to one aspect of the present invention, there is provided a method of predicting the failure of a rock formation surrounding a subterranean cavity, including the steps of measuring a set of parameters relating to pressure conditions and stresses in the rock formation surrounding the cavity; using the set of parameters to determine a rock strength; determining a first characteristic length relating to the size of the cavity; determining a second characteristic length relating to the grain size of the rock formation surrounding the cavity; using the first and second characteristic lengths to determine a correction for the rock strength; correcting said rock strength; and using a failure criterion and the corrected rock strength to predict a condition under which the rock formation is expected to produce debris.

A cavity can be a wellbore without lining (open hole) or perforation tunnels or other spaces created in a subterranean formation by using chemical or physical forces such as explosives and drilling equipment.

The set of parameters used to characterize the formation surrounding the cavity may include measurement as performed by logging devices, such as sonic, gamma-ray logging devices or NMR based logging devices. Important parameters are for example density or porosity, clay content, or p- and s-wave slowness.

The characteristic length relates to the dimensions of a cavity or grain and is preferably the diameter or radius or the closest approximation of the diameter or radius, given the irregular dimensions of those subterranean objects.

The results of the prediction can be used to monitor wellbore stability while drilling or optimize the production parameters for a hydrocarbon reservoir.

The normalization of the cavity dimension or length with the grain size yields a correction factor that can be used to derive an apparent rock strength. In this way, the scale and plasticity effects are lumped into an apparent strength calculation. This apparent rock strength can be used with estimates of in-situ stresses and pore pressure in a 3-D poroelastic model and failure criterion as Mohr-Coulomb for the calculation of the critical parameters related to the stability of the cavity, such as draw-down pressure and the onset of sand production.

Combined with the appropriate measuring-while-drilling (MWD) or logging-while-drilling (LWD) technology, it can be converted into a prediction tool to estimate the rock stability during drilling operation in real time. As such it could contribute significantly to the prevention of stuck-pipe problems, currently the cause of significant losses in the oilfield industry.

These and other features of the invention, preferred embodiments and variants thereof, possible applications and advantages will become appreciated and understood by those skilled in the art from the following detailed description and drawings.

MODE(S) FOR CARRYING OUT THE INVENTION

Figure 1:
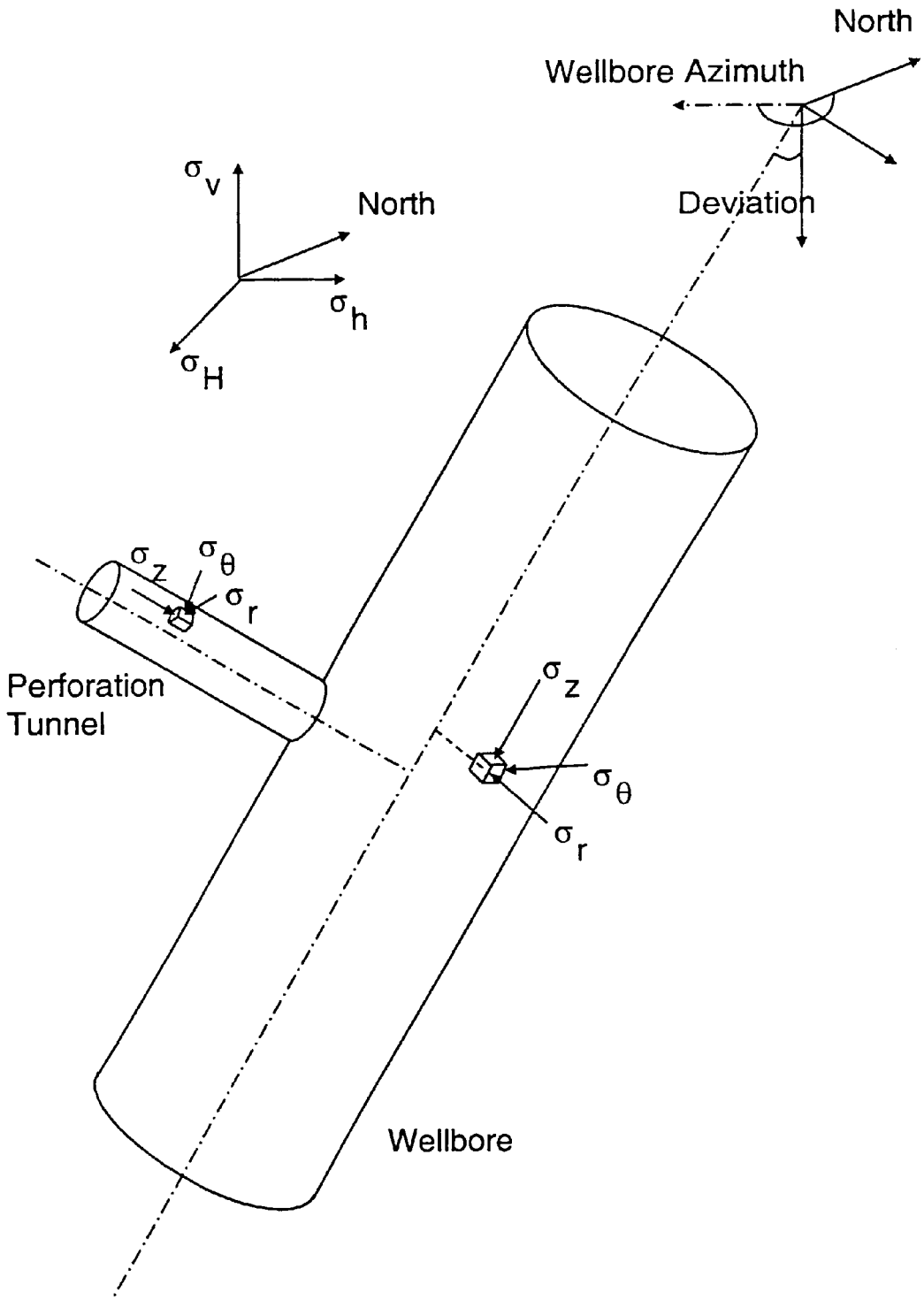
FIG. 1 is a schematic drawing of a wellbore and a perforation tunnel illustrating the directions of stresses.

The underlying idea is to use log-data (mainly sonic data) for the derivation of rock elastic constants and formation strength parameters. These parameters can be used with estimates of in-situ stresses and pore pressure in a 3-D poro-elastic model and Mohr-Coulomb failure criterion for the calculation of the critical draw-down pressure.

The method described below assumes clean sandstone as formation material.

The bulk porosity can be derived from the bulk density $\rho_b$ of a fluid saturated porous rock, which is given by $$\rho_b=\phi\rho_f+(1-\phi)\rho_s, \quad [1]$$

where $\rho_s$ is the density of the solid grains and $\rho_f$ is the fluid density. Solving for the bulk porosity results in $$\varphi=\frac{\rho_s-\rho_b}{\rho_s-\rho_f} \quad [2]$$

Approximate default values can be assumed for both densities, e.g., $\rho_s$=2.75 g/cm$^3$ and $\rho_f$=1.1 g/cm$^3$.

The elastic parameters are computed from log compressional and shear wave velocities. Methods and apparatus to perform the required measurements are known as such in the art. For example, the U.S. Pat. Nos. 4,862,991, 4,881,208 and 4,951,267 refer to logging tools for measuring shear and compressional wave slowness. The Schlumberger DSI™. tool for conventional logging or the ISONIC™ tool for logging-while-drilling are capable of measuring the required data. Reference to those tools are found for example in the Schlumberger Oilfield Review, Spring 1998, 40–66.

The elastic parameters of the formation as used by the present invention can be determined using the compressional and shear wave velocities log data. The Poisson ratio $\upsilon$, the shear modulus G, the Young's modulus E and the bulk modulus K are calculated from the p and s wave slownesses (i.e. the reciprocal of the velocity), $Dt_c$ and $Dt_s$, according to equations:

$$v=\frac{0.5(Dt_s/Dt_c)^2-1}{(Dt_s/Dt_c)^2-1} \quad [3]$$

$$G=\frac{\rho_b}{Dt_s^2}\alpha \quad [4]$$

$$E=2G(1+\upsilon) \quad [5]$$

$$K=\frac{E}{3(1-2v)} \quad [6]$$

The rock strength parameters can be calculated in terms of the uniaxial (or unconfined) compressive strength UCS from the empirical correlations known as Coates and Denoo equation:

$$UCS=(114+97V_{sh})K(\text{in mio. psi})E(\text{in mio. psi}) \quad [7]$$

where the clay content $V_{sh}$ can be determined using for example gamma ray logs or information from core.

The pore pressure, $P_0$, is given by the reservoir pressure. Methods and apparatus to measure the reservoir pressure (and the wellbore pressure $p_w$) are known and reference is made to the U.S. Pat. No. 5,789,669 for details of such measurements. The reservoir pressure is likely to vary with time according to the predicted performance of the reservoir.

The vertical in-situ stress $\sigma_v$ (illustrated by FIG. 1) is estimated from the overburden weight. The magnitude of the minimum horizontal stress can be obtain either from consolidation theory according to $$\sigma_h=\frac{v}{1-v}\sigma_v+\frac{1-2v}{1-v}\beta p_0 \quad [8]$$

where $\beta$ is the Biot coefficient, or from frictional equilibrium. If possible, a stress measurement or extended leak-off test should be used to verify which assumption gives better estimates.

Finally, in a tectonic environment the horizontal stresses are unequal $$\sigma_H=K\sigma_h \quad [9]$$

The ratio between horizontal stresses can be estimated from borehole breakouts or by the simulation of field tectonic movement using finite elements. In general as much information as possible should be used in constraining the values of the horizontal stresses.

In the following the methodology for calculating the optimum draw-down pressure DP based on 3-D elastic solution. The basic equations are known. The known 3-D elastic solution is augmented with extra terms for taking into account for the gradient of pore or reservoir pressure during production.

As illustrated by FIG. 1, the method can be applied to estimate the stability of sections of the wellbore or to estimating the stability of other cavities such as perforation tunnels.

Transforming the parameters from a vertical into a wellbore coordinate system, the stresses at a point on the borehole wall (r=R) and at an angle $\theta$ from the axis x are given by $$\sigma_r=p_w \quad [10]$$

$$\sigma_\theta=(\sigma_{xx}+\sigma_{yy}-p_w)-2(\sigma_{xx}-\sigma_{yy})\cos 2\theta-4\sigma_{xy}\sin 2\theta-(P_0-p_w)\beta\frac{1-2v}{1-v} \quad [11]$$

$$\sigma_z=\sigma_{zz}-2v(\sigma_{xx}-\sigma_{yy})\cos 2\theta-4\sigma_{xy}\sin 2\theta-(P_0-p_w)\beta\frac{1-2v}{1-v} \quad [12]$$

$$\sigma_{\theta z}=-2\sigma_{xz}\sin\theta-2\sigma_{yz}\cos\theta \quad [13]$$

$$\sigma_{rz}=0 \quad [14]$$

where the original input in-situ stresses, $\sigma_H$, $\sigma_h$, $\sigma_v$ have first been transformed into the Cartesian components of a wellbore coordinate system and then, using eqs [10]–[14], into cylindrical wellbore coordinates. The parameter $p_w$ denotes the pressure in the wellbore. For a weak reservoir sandstone a reasonable value for the Biot coefficient is $\beta=1$.

The principal stresses can be found from the eigenvalues of the stress tensor $$[\sigma]=\begin{bmatrix}\sigma_r & \sigma_{r\theta} & \sigma_{rz}\\ \sigma_{\theta r} & \sigma_\theta & \sigma_{\theta z}\\ \sigma_{zr} & \sigma_{z\theta} & \sigma_z\end{bmatrix} \quad [15]$$

using the Matlab™ function princ=eigs(s), and can be put in order, $\sigma_3$, $\sigma_2$ and $\sigma_1$, the maximum compressive stress.

The Mohr-Coloumb failure criterion can be expressed in the following form $$f=UCS-\sigma'_1 \quad [16]$$

The effective stress $\sigma'_1$ at the borehole wall is given by $$\sigma'_1=\sigma_1-\beta p_w. \quad [17]$$

It was found that the failure criterion, eq. [16], and any other failure criterion using the uniaxial compressive strength UCS can be improved by taking into account the scaling effect, i.e. the characteristic dimension of the perforations through which hydrocarbons are produced. Experimental data showed that by introducing a scaling factor including the grain size of the formation, the estimates of the critical production parameters can be improved and applied to a broader range of rock types.

Applying the scaling factor to the uniaxial compressive strength UCS yields the correction $$UCS_{appar.}=2UCS\ a\left(\frac{D_{perf}}{D_{grain}}\right)^{-n} \quad [18]$$

where UCS is defined by eq. [7] and $D_{perf}$ is the diameter of the perforation and $D_{grain}$ is the diameter of the grains of the rock formation. The fitting parameters a and n are determined as 16.1064 and 0.3374, respectively, by may vary to some extend depending on the fitted data and fitting algorithm.

In the absence of a measured grain size, $D_{grain}$ can be estimated using prior knowledge of the rock or, at worst, simply approximated by a constant default value. Experimental data suggest 0.2 mm for such a default value.

The corrected $UCS_{appar.}$ can be used in the failure criterion [16] and standard mathematical optimization procedures to produce a better estimate of the maximal rock strength and, hence, a better estimate of the maximum draw-down pressure.

Figure 2:
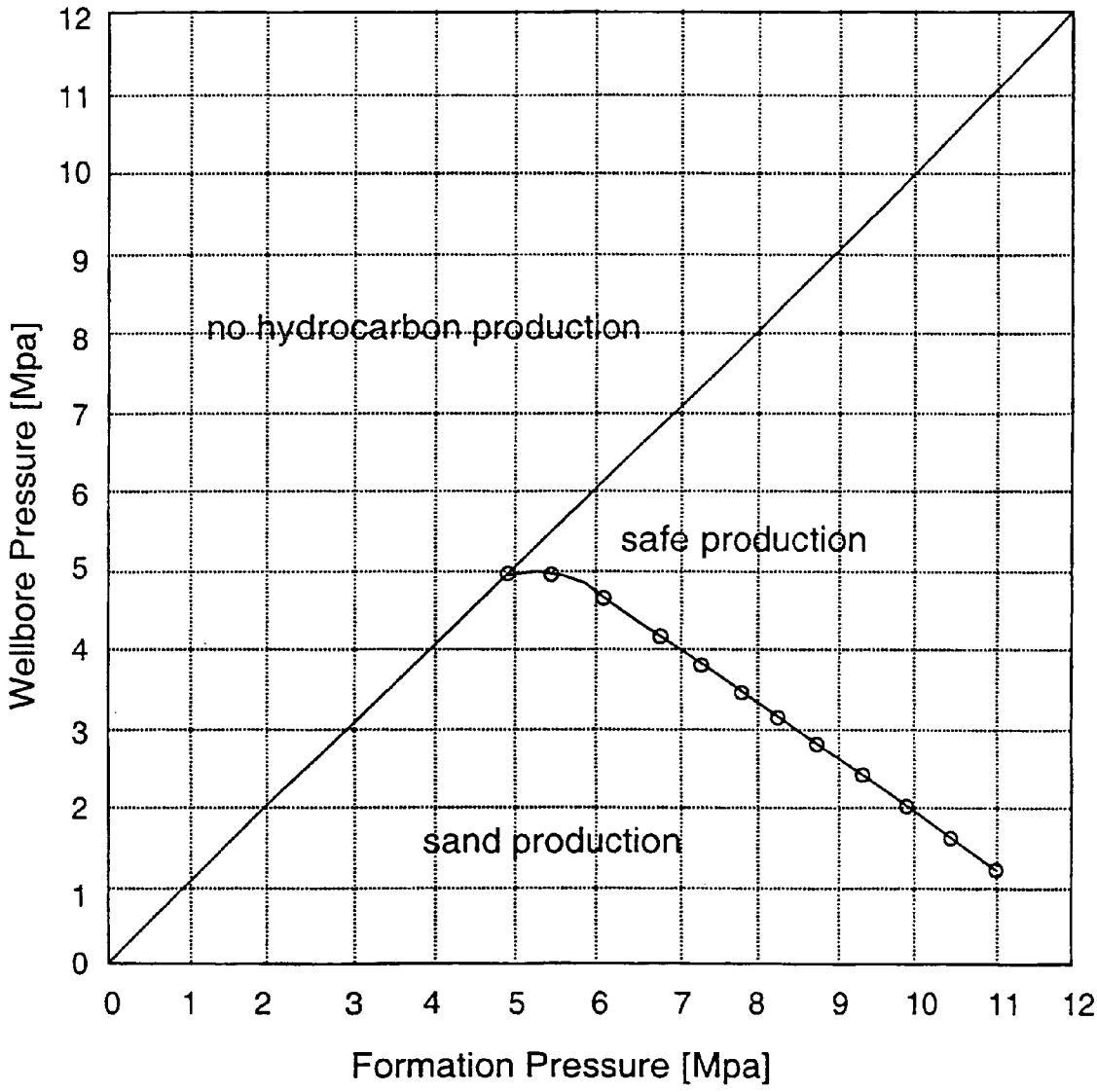
FIG. 2 shows the critical draw-down pressure curve for a simulated reservoir.
Figure 3:
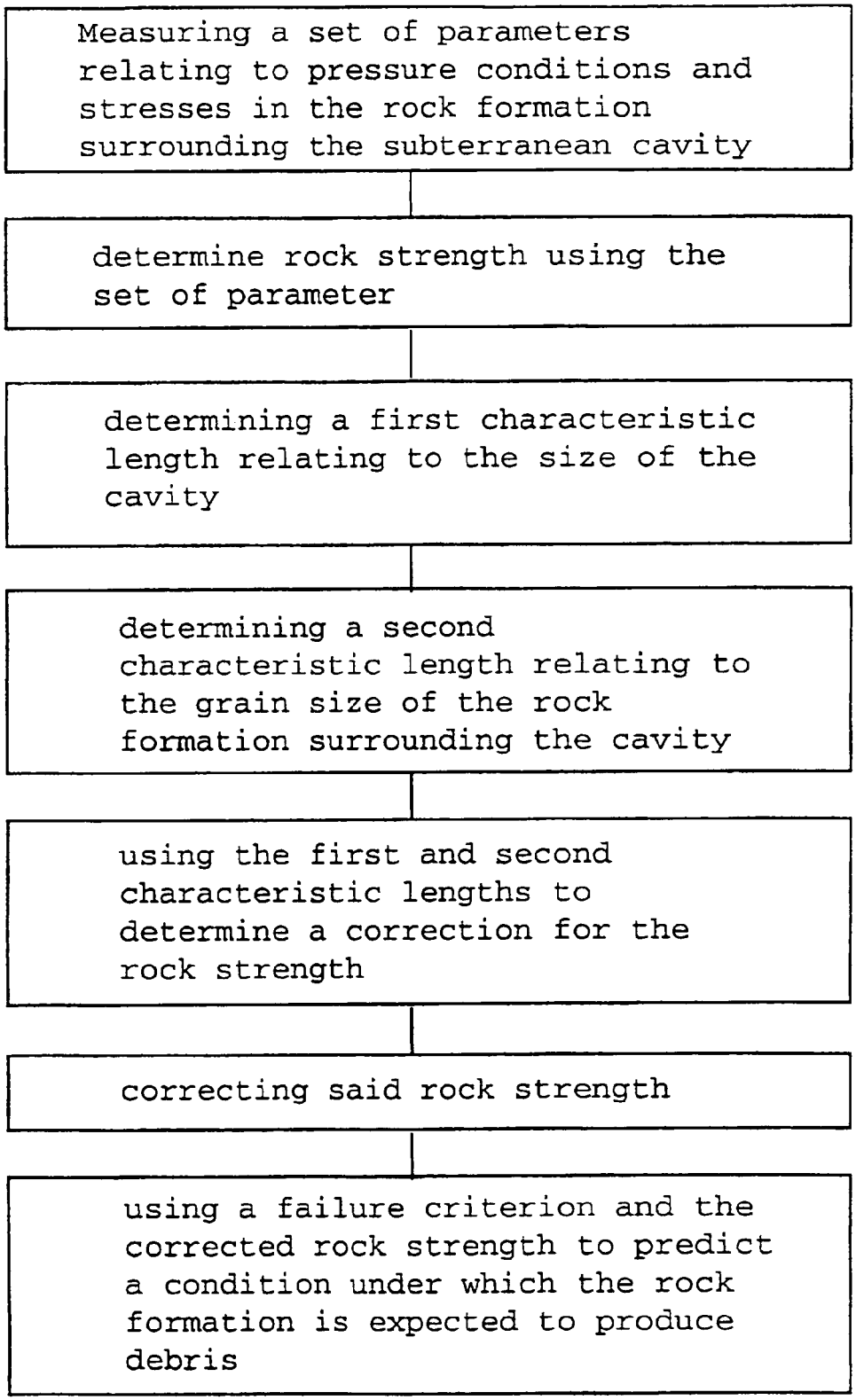
FIG. 3 charts steps of the present invention.

FIG. 2 illustrates a simulated example using input values taken from known parameters of a drilled well in the North Sea.

The input parameters are

Insitu Stresses:

Vertical stress $\sigma_v$=24.82 MPa;

Min. horizontal stress $\sigma_h$=15.63 MPa;

Max. horizontal stress $\sigma_h$=17.19 MPa;

Formation pressure $P_0$=11.03 MPa.

Rock Parameters:

Poisson ratio $\upsilon$=0.25;

Uniaxial compressive strength UCS=4.07 MPa;

Grain size $D_{grain}$=0.2 mm

Well Data:

Well diameter $D_{well}$=0.20 m

Inclination I=90 degrees

Azimuth a=0 degrees

Perforation Data

Perforation diameter $D_{perf}$=0.01 m

Phasing $\phi$=55 degrees

The horizontal stresses are assumed to be equal and they are calculated from the consolidation eq. [9]. The formation strength is calculated in terms of the corrected $UCS_{appar.}$ from available log data and the correlation function [7].

FIG. 2 shows the optimum wellbore pressure for sand-free production calculated using the above approach at the beginning of (0% depletion) and during production. During depletion it is assumed that the total vertical in-situ stress remains unchanged, therefore, the vertical effective stress increases by the same amount the pore pressure decreases. The variation of the effective horizontal stresses is taken empirically to be 50% of the variation in the vertical effective stress. Though safe production is possible within the area limited by calculated curve for the onset of sand production (marked by circles), maximum hydrocarbon is achieved by setting the well parameters, i.e. most notably the wellbore pressure as close to the curve as possible.

Using the same input data and stability model (i.e. UCS) without the correction proposed by the present invention, the optimization predicts that the wellbore can not be produced without sand.

The invention claimed is:

1. A method of predicting the failure of a rock formation surrounding a subterranean cavity, comprising the steps of measuring a set of parameters relating to pressure conditions and stresses in the rock formation surrounding the subterranean cavity;

using the set of parameters to determine a rock strength;

determining a first characteristic length relating to the size of the cavity;

determining a second characteristic length relating to the grain size of the rock formation surrounding the cavity;

using the first and second characteristic lengths to determine a correction for the rock strength;

correcting said rock strength; and using a failure criterion and the corrected rock strength to predict a condition under which the rock formation is expected to fail, producing debris.

2. The method according to claim 1 wherein the set parameters includes sonic wave slowness.

3. The method according to claim 1 wherein the set parameters includes the formation density.

4. The method according to claim 1 wherein the set parameters includes the wellbore and formation pressure.

5. The method according to claim 1 wherein the failure criterion is a shear failure criterion (Mohr-Coulomb).

6. The method according to claim 1 wherein the failure criterion includes a term corresponding to an uniaxial compressive strength (UCS).

7. The method according to claim 1 wherein the correction includes forming the quotient of the first and the second characteristic length.

8. The method according to claim 1 further including the step of determining a wellbore production pressure using the failure criterion.

9. The method of claim 1 wherein the set of parameters relating to pressure conditions and stresses in the rock formation surrounding the cavity are at least partly measured while drilling.

* * * * *